US006429772B1

(12) United States Patent
Lizzi

(10) Patent No.: US 6,429,772 B1
(45) Date of Patent: Aug. 6, 2002

(54) PAGER WITH UNREAD PAGER MESSAGE INDICATOR

(75) Inventor: Ronald S. Lizzi, West Hartford, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/157,346

(22) Filed: Sep. 18, 1998

(51) Int. Cl.[7] ..... G08B 5/22
(52) U.S. Cl. ..... 340/7.55; 340/10.6
(58) Field of Search ..... 340/825.44, 10.6, 340/7.55; 455/31.3, 412, 466, 38.1; 379/93.24

(56) References Cited

U.S. PATENT DOCUMENTS 4,385,295 A 5/1983 Willard et al. ..... 340/825.44
4,786,902 A 11/1988 Davis et al. ..... 340/825.44
5,043,718 A * 8/1991 Shimura ..... 340/825.44
5,258,751 A * 11/1993 DeLuca et al. ..... 340/825.44
5,347,269 A * 9/1994 Vanden Heuvel et al. ..... 340/825.44
5,936,548 A * 8/1999 Takatsuka ..... 340/825.44
6,069,568 A * 5/2000 Tsuchiyama ..... 340/825.44

* cited by examiner

*Primary Examiner*—Michael Horabik
*Assistant Examiner*—M Shimizu
(74) *Attorney, Agent, or Firm*—Carmody & Torrance LLP

(57) ABSTRACT

A pager configured for storing and displaying a plurality of messages, each of the plurality of messages having associated therewith a message slot number, wherein the pager displays each one of the plurality of messages and the message slot number associated therewith and flashes the associated message slot number when the respective message that is displayed has not been read.

13 Claims, 3 Drawing Sheets

PAGER WITH UNREAD PAGER MESSAGE INDICATOR

BACKGROUND OF THE INVENTION

The present invention relates generally to pagers, and in particular, to an improved display methodology of indicating to a user that a particular message is an unread pager message. The invention also relates to a construction that carries out the improved display methodology.

Pagers that have a visible display for indicating unread messages are known. One such example is described in U.S. Pat. No. 4,385,295. U.S. Pat. No. 4,385,295, which is incorporated by reference as if fully set forth herein, describes the use of logic gates and other circuitry to indicate to a user whether a particular received message has been read. U.S. Pat. No. 4,385,295 also describes circuitry for determining when the message has been read so as to cease the flashing of a particular icon associated with a particular message.

The use of flashing message indicators has also been implemented in at least one Motorola pager. For example, in Motorola's MemoJazz™ pager, a display screen indicates the total number of stored messages, and in addition, has an icon representing each stored message. Accordingly, four (4) stored messages would result in the display of four (4) displayed icons. The flashing of a particular icon indicates both that there is an unread message and which stored message is unread. More than one icon may be flashing at any one time indicating more than one unread message. Sequencing through the icons highlights the associated (read or unread) message to be read. FIG. 3 illustrates the display screen for the MemoJazz™ pager and can be found in the instruction manual therefor.

The MemoJazz™ pager does not allow for the indication of the unread messages as the user is scrolling through the messages themselves. That is, in the MemoJazz™ pager, a user will only know of an unread message, and its particular slot number, upon the visual display of the foregoing display screen. As the user is cycling through and among the stored messages, the user cannot ascertain whether the message has been read or not.

That is, it is desirable to be able to view the actual message along with the message's "message slot number", and it is further desirable to indicate to the user whether the message has been read by causing the "message slot number" to flash.

The Motorola PROENCORE™ pager is also deficient in the foregoing respect. The PROENCORE™ pager has a display screen exemplified by the display illustrated in FIG. 4, that may include for example, along with the actual message, a message time stamp and a "message slot number".

Undesirably, the PROENCORE™ pager is not adapted to indicate whether the particular message the user is viewing is a message that has been read before. Contrary thereto, the PROENCORE™ pager merely provides a general, periodic audible alert along with a display indicating the number of unread messages, until all the messages have been read.

Accordingly, a pager that overcomes the aforementioned deficiencies, and in particular, that can indicate whether the message that the user is currently viewing has been read before, is desired. The invention disclosed herein achieves the aforementioned and below mentioned objectives.

SUMMARY AND OBJECTS OF THE INVENTION

Generally speaking, and in accordance with the invention, a pager that can indicate to a user whether a message has been previously read or is unread is provided. The pager can store and display a plurality of messages, and associates with each message a message slot number. In a preferred embodiment, the pager determines whether each of the plurality of messages has been read, and upon the displaying of a message and the message slot number associated therewith, flashes the associated message slot number while a message that has not been read is displayed on the display. The pager can also terminate the flashing of the associated message slot number after the respective message has been read. In one contemplated embodiment, the flashing terminates while the respective message is still being displayed on the display. Alternatively, the flashing may terminate only after the respective message is subsequently displayed on the display.

Accordingly, it is an object of the present invention to provide a pager that provides visual indication to a user whether a particular message has been read.

Another object of the present invention is to indicate an unread message without requiring additional icons or other indicators.

Another object of the present invention is to provide a pager that provides visual indication to a user whether a particular message has been read at the time the message is being displayed on the screen.

Still other objects and advantages of the invention will be obvious from the specification.

The invention accordingly comprises the features of construction, combination of elements, arrangement of parts and sequence of steps which will be exemplified in the construction and methodology hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
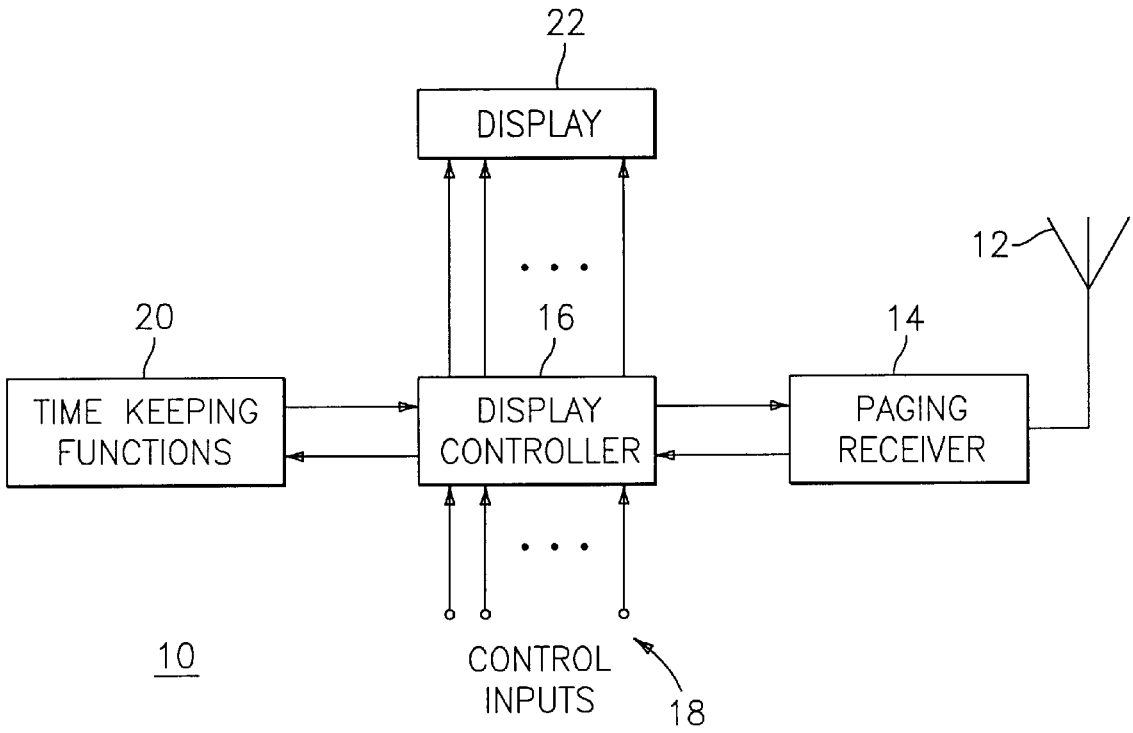
FIG. 1 is a functional block diagram of a device constructed in accordance with the present invention.

Reference is first directed to FIG. 1, which represents a simplified functional block diagram for a pager/watch device 10, although the present invention is equally applicable to a device that contains only pager functionality.

An electronic watch circuit 20, which is coupled to a controller 16, provides time information such as time and day and date, normally displayed on a display 22. An antenna 12 is coupled to a paging receiver 14, which itself is coupled to controller 16. Paging receiver 14 receives transmitted coded message signals and displays the received message information on display 22. It will be appreciated by one skilled in the art that the time information being generated by watch circuit 20 may include other functions such as elapsed time, interval times, and an alarm. Control of watch circuit 20 and paging receiver 14 is provided by user control inputs 18, which are coupled to controller 16, and which may be device switches or buttons as would be well understood in the art.

In normal operation, the pager/watch arrangement of FIG. 1 may function like a watch with the present time displayed on display 22. The device switches provide control of the watch functions through controller 16. However, when transmitted coded message signals, or pages, are received and decoded by paging receiver 14 in a manner well known to one skilled in the art, a control signal is generated by paging receiver 14 causing the pager/watch arrangement to function as a display pager. This may be effected by changing both the information displayed and the normal functions of the device switches. Thus, after the page has been received, the display may indicate a message was received in a well known manner. Paging receiver 14 will include memory for storage of the message information. Readout of the message information stored in the memory is then controllable by the same device switches normally used to control the watch functions.

Controller 16 preferably includes a subcontroller for steering control inputs to either time keeping circuit 20 or paging receiver 14. Implementations for watch circuit 20 and paging receiver 14 are separately well known to those skilled in the art, and will therefore be omitted for brevity. Outputs from watch circuit 20 and paging receiver 14 provide time and message information, respectively, to a display selector provided within controller 16. The display selector may select time or message information for display depending upon which section of the watch/pager device is being controlled. The information selected by the display selector may be provided to a display interface which drives display 22.

Paging receiver 14 preferably includes a receiver circuit for receiving the transmitted coded message signals, consisting of transmitted selective call signaling information and transmitted message information. The transmitted coded message signals are demodulated in the receiving circuit, and provided at the output thereof as a stream of binary information representing demodulated coded message signals consisting of selective call signaling information and message information. Paging receiver 14 also includes a decoder and memory which stores predetermined address information consisting of one or more addresses to which paging receiver 14 will respond. The memory within paging receiver 14 is capable of storing multiple messages received at different times.

Controller 16 also includes circuitry for controlling the time duration during which received message information is displayed on display 22.

Other control functions, including further details of the foregoing operations are more fully described in U.S. Pat. No. 4,786,902, which is incorporated by reference as if fully set forth herein.

As stated above, one of the advantages of the present invention is the ability to step through a plurality of stored pages while simultaneously indicating to the user whether the page has been read. The present invention achieves this objective by utilizing the following methodology.

Firstly, whether a page is deemed "read" can be based on one or more criteria left to the designer. For example, the device may deem the particular message read after the respective message has been displayed for a predetermined period of time, such as 3 seconds. In this way, the designer can permit a user to skim quickly through the messages, such as the first lines thereof, without having the whole message deemed "read". Alternatively, the particular message may be deemed "read" as soon as the message is displayed, such that the mere displaying of the message indicates that the message has been read.

Figure 2:
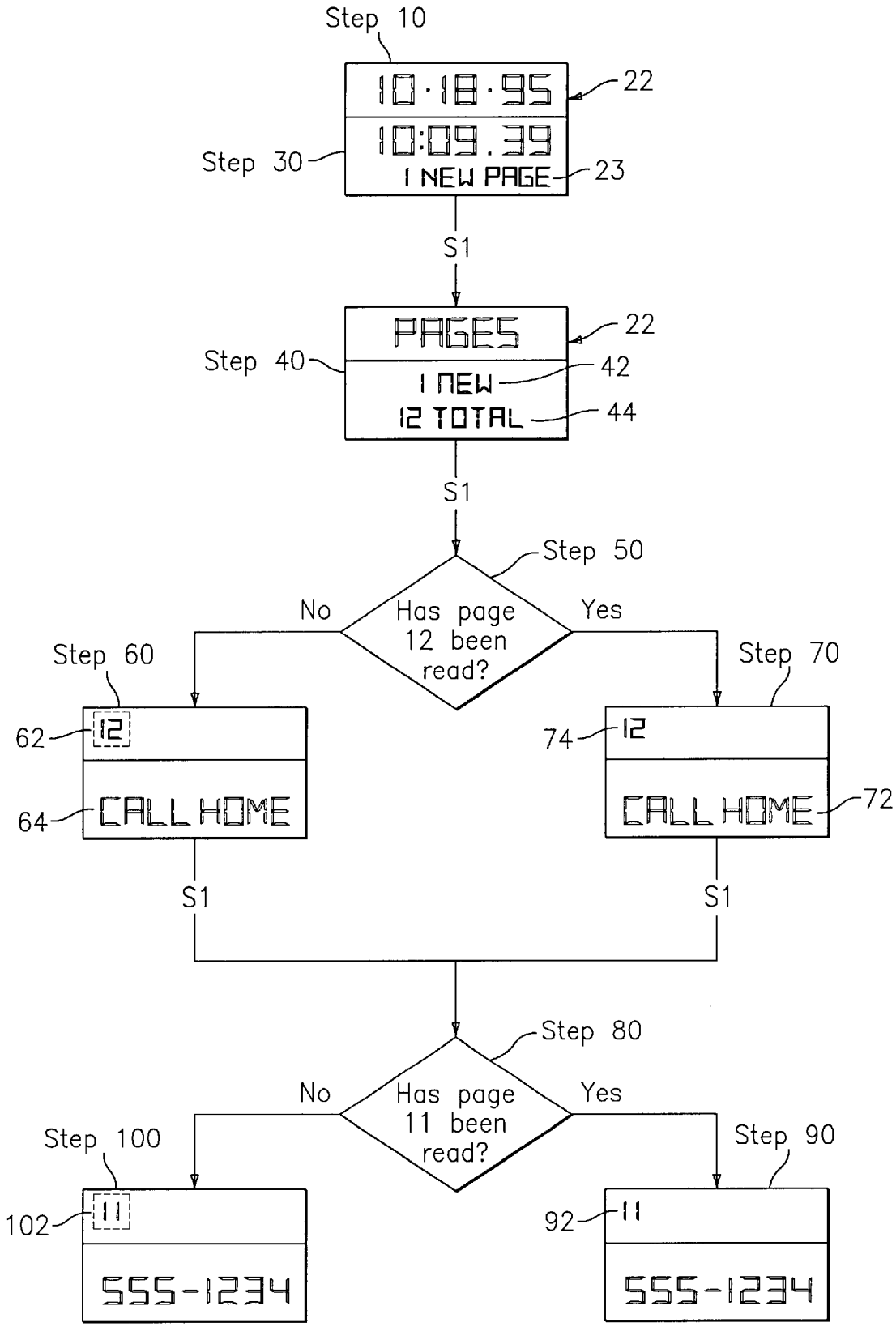
FIG. 2 is a flowchart illustrating the operation of the device in accordance with the present invention.
Figure 3:
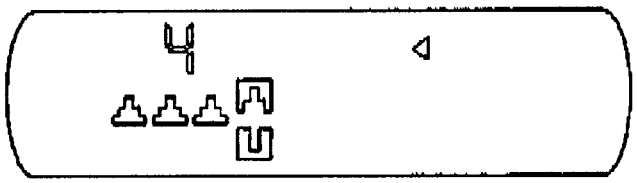
FIG. 3 (PRIOR ART)
FIG. 3 is an exemplary display screen of an existing Motorola MemoJazz™ pager.
Figure 4:
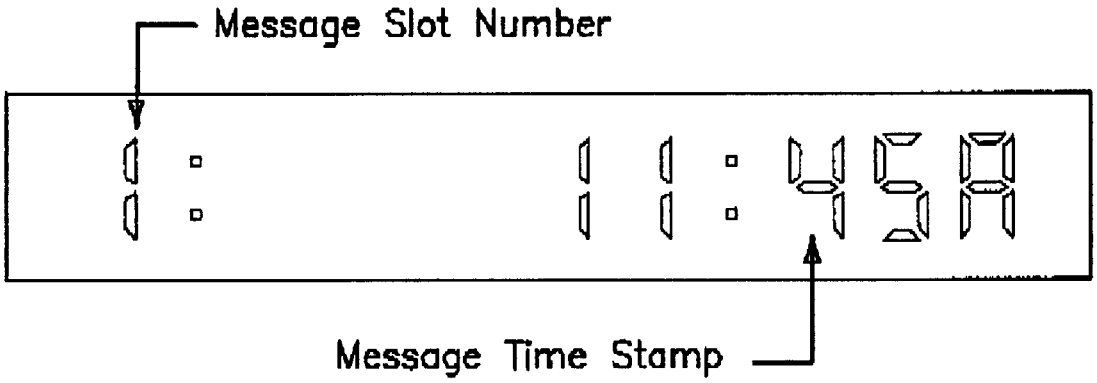
FIG. 4 (PRIOR ART)
FIG. 4 is an exemplary display screen of an existing Motorola PROENCORE™ pager.

To carry out the preferred methodology, reference is now made to FIG. 2. In the exemplary and preferred embodiment, device 10 may be initially in a time-of-day mode and therefore displaying the time-of-day (step 10). Display 22 may also display a "NEW PAGE" indication 23 upon the receipt thereof. The indication to a user that a page has been received may be implemented in a variety of ways, such as that described in U.S. Pat. No. 4,786,902, or U.S. Pat. No. 4,385,295, which is also incorporated by reference as if fully set forth herein.

Upon the receipt of a new page message, or upon the manual entry into the pager mode at the prompting of a user in a known manner, display 22 may illustrate the total number of messages 42 currently being stored and the number of new (i.e. unread) messages 44 (step 40). In the current example, there are twelve (12) messages in total with only one (1) message having not been read.

Upon the activation of a designated "read" button (coupled to one of the control inputs 18) a decision is taken whether the page (in the illustrated example, the display of messages begin with the most recently received message, i.e. message 12) has been read (step 50).

If the message has been read, along with the display of the message 72, the "message slot number" 74 is merely displayed much in the same manner as it is displayed in the known PROENCORE™ pager. However, if controller 16 determines that the page has not been read, such determination being made in accordance with methodology being well understood by one of skill in the art, then the "message slot number" 62 will flash (as indicated by the dotted rectangle). Message 64 is also displayed in a known manner (step 60). Upon the "reading" of message 12, which may be variously defined, for example as stated above, the "message slot number" will cease flashing. Furthermore, the termination of the flashing can occur while the message is being displayed or only after subsequent display. In either case, any subsequent reading of message 12 will not yield a flashing "message slot number" 62.

Any further sequencing through of the stored messages, such as that taking place in steps 80–100 with respect to message 11, is similar to that above with respect to message 12. That is, upon the activation of the appropriate button or switch to cause the device to sequence to the next page message, a decision is taken whether the message had been previously read (step 80). If message 11 has been read (step 90), "message slot number" 92 will not flash and the user will know therefrom that the message has been previously read. If the message has not been read, then "message slot number" 102 will continuously flash until the message is read as explained above. It is also noted that step 100 is illustrative only since display 22 in step 40 was indicated as having only one unread message. However, this is only by way of example as one skilled in the art would understand the purpose of the illustration.

This display methodology can take place for the remainder of the stored messages.

It can therefore be seen that the present invention provides a new and advantageous method of indicating unread pager messages to a user. In particular, the indication is more timely as the flashing indication of an unread message is provided to the user at the time the user is viewing the message. The present invention overcomes the deficiency in the prior art of merely having a display, display in total, which of the messages have been read. The present invention achieves the stated objective by indicating unread messages as the user is stepping through the stored messages.

Accordingly, it will also be appreciated that controller 16 preferably includes the software necessary to carry out the foregoing display methodology. In particular, controller 16 determines whether each one of the plurality of messages has been read and causes the flashing of the associated message slot number when the respective message that has not been read is displayed on the display. Controller 16 may also cause the termination of the flashing of the associated message slot numbers as disclosed herein. Similarly, controller 16 may determine whether the message has been previously displayed in a manner as disclosed herein. However, modified constructions by one of skill in the art are contemplated hereby and would still remain within the scope of the present invention.

It will thus be seen that the objects set forth above, among those made apparent from the preceding description, are efficiently attained and, since certain changes may be made in the above constructions or methodology without departing from the spirit and scope of the invention, it is intended that all matter contained in the above description or shown in the accompanying drawings shall be interpreted as illustrative and not in a limiting sense.

I claim:

1. A pager with a plurality of memory locations for storing a corresponding plurality of messages, each of the plurality of messages having associated therewith a message slot number, the pager comprising:

display means for simultaneously displaying each one of the plurality of messages and the message slot number associated therewith;

determining means for determining whether each one of the plurality of messages has been read; and flashing means for flashing the associated message slot number when the respective message that has not been read is displayed on the display means.

2. The device as claimed in claim 1, including termination means for terminating the flashing of the associated message slot number after the respective message has been displayed for a predetermined period of time.

3. The device as claimed in claim 2, wherein the termination means terminates the flashing while the respective message is still being displayed on the display means.

4. The device as claimed in claim 2, wherein the termination means terminates the flashing only after the respective message is subsequently displayed on the display means.

5. The device as claimed in claim 1, wherein the determining means determines whether the message has been previously displayed; wherein the previous displaying of the message is an indication that the message has been read.

6. The device as claimed in claim 1, wherein the determining means determines whether the message has been previously displayed for a predetermined period of time; wherein the displaying of the message for the predetermined period of time is an indication that the message has been read.

7. A pager with a plurality of memory locations for storing a corresponding plurality of messages, the pager being able to access each of the messages, the pager comprising:

a display for displaying each one of the plurality of messages simultaneously with the display of an indication whether the respective message has been read;

wherein each of the plurality of messages has associated therewith a message slot number, each of the plurality of messages and the message slot number associated therewith being displayable on the display at the same time; and an indicator for indicating to the user whether the respective message has been read by flashing the associated message slot number when the respective message is displayed on the display.

8. A method of distinguishing between read and unread messages in a pager with a plurality of memory locations for storing a corresponding plurality of messages, each of the plurality of messages having associated therewith a message slot number, the method comprising the steps of:

determining whether each one of the plurality of messages has been read;

displaying, on a display, each one of the plurality of messages simultaneously with the display of the message slot number associated therewith; and flashing the associated message slot number while the respective message that has not been read is being displayed.

9. The method as claimed in claim 8, including the step of terminating the flashing of the associated message slot number after the respective message has been displayed for a predetermined period of time.

10. The method as claimed in claim 9, wherein the flashing of the associated message slot number terminates while the respective message is still being displayed on the display.

11. The method as claimed in claim 9, wherein the flashing of the associated message slot number terminates only after the respective message is subsequently displayed on the display.

12. The method as claimed in claim 8, including the step of determining whether the respective message has been previously displayed; wherein the previous displaying of the message is an indication that the message has been read.

13. The method as claimed in claim 8, including the step of determining whether the respective message has been previously displayed for a predetermined period of time; wherein the displaying of the message for the predetermined period of time is an indication that the message has been read.

* * * * *